US009828152B2

(12) United States Patent
Dinh

(10) Patent No.: US 9,828,152 B2
(45) Date of Patent: Nov. 28, 2017

(54) IN-LINE CABLE TIE WITH FLEXIBLE HEAD

(71) Applicant: Thomas & Betts International LLC, Wilmington, DE (US)

(72) Inventor: Cong Thanh Dinh, Collierville, TN (US)

(73) Assignee: Thomas & Betts International LLC, Wilmington, DE (US)

( * ) Notice: Subject to any disclaimer, the term of this patent is extended or adjusted under 35 U.S.C. 154(b) by 18 days.

(21) Appl. No.: 14/793,822

(22) Filed: Jul. 8, 2015

(65) Prior Publication Data

US 2016/0016709 A1 Jan. 21, 2016

Related U.S. Application Data

(60) Provisional application No. 62/024,612, filed on Jul. 15, 2014.

(51) Int. Cl.
*B65D 63/10* (2006.01)

(52) U.S. Cl.
CPC .... *B65D 63/1072* (2013.01); *B65D 2563/101* (2013.01)

(58) Field of Classification Search
CPC ..... B65D 63/1072; B65D 2563/101
USPC ..... 24/16 PB
See application file for complete search history.

(56) References Cited

U.S. PATENT DOCUMENTS 2,977,145 A 3/1961 Rifkin
3,588,962 A 6/1971 Feldberg
3,605,199 A 9/1971 Eberhardt
3,660,869 A 5/1972 Caveney et al.
3,735,448 A 5/1973 Waddington
3,872,547 A 3/1975 Caveney et al.
3,886,630 A 6/1975 Emery
3,887,965 A * 6/1975 Schuplin ..... B65D 63/1063 24/16 PB
3,952,373 A 4/1976 Noorily
3,965,538 A 6/1976 Caveney et al.
3,967,345 A 7/1976 Sumimoto
(Continued)

FOREIGN PATENT DOCUMENTS

EP 1 818 275 A1 8/2007
GB 1 287 651 9/1972
(Continued)

*Primary Examiner* — Robert J Sandy
*Assistant Examiner* — Rowland Do
(74) *Attorney, Agent, or Firm* — Hoffmann & Baron, LLP

(57) ABSTRACT

A low profile cable tie includes a strap having a tail at one end and a locking head at the other end. The locking head has passage for receipt of the tail therethrough. The strap includes a planar surface between the tail and the locking head having a plurality of notches therealong. The locking head includes a base portion and a head portion flexibly connected to the base portion with the passageway formed therebetween. The head portion includes a plurality of locking teeth extending into the passageway for engagement with the notches of the strap body. The notches engage a number of teeth less than all of the locking teeth upon insertion of the strap into the passageway. The head is flexibly pivotable so that more than the number of locking teeth engage the notches upon attempt to withdraw the strap from the head.

10 Claims, 4 Drawing Sheets

(56) References Cited

U.S. PATENT DOCUMENTS

| | | | | |
|---|---|---|---|---|
| 3,973,292 | A * | 8/1976 | Bonnet | B65D 63/1072 24/16 PB |
| 4,003,106 | A | 1/1977 | Schumacher et al. | |
| 4,092,765 | A | 6/1978 | Joyce | |
| 4,287,644 | A | 9/1981 | Durand | |
| 4,413,380 | A | 11/1983 | Suzuki | |
| 4,490,887 | A * | 1/1985 | Sarton et al. | B65D 63/1072 24/16 PB |
| 4,580,319 | A * | 4/1986 | Paradis | B29C 45/0055 24/16 PB |
| 4,658,478 | A * | 4/1987 | Paradis | B29C 45/0055 24/16 PB |
| 4,776,067 | A | 10/1988 | Sorensen | |
| 5,295,285 | A | 3/1994 | Shely | |
| 5,414,904 | A | 5/1995 | Sampson | |
| 5,675,870 | A | 10/1997 | Cooper | |
| 5,745,957 | A | 5/1998 | Khokhar et al. | |
| 5,781,975 | A | 7/1998 | Wells, Jr. et al. | |
| 5,836,053 | A | 11/1998 | Davignon et al. | |
| 5,890,265 | A | 4/1999 | Christian et al. | |
| 6,076,234 | A | 6/2000 | Khokhar et al. | |
| 6,185,792 | B1 | 2/2001 | Nelson et al. | |
| 6,449,808 | B1 * | 9/2002 | Zappa et al. | G09F 3/037 24/16 PB |
| 6,511,108 | B1 * | 1/2003 | Roessner, III | B65D 55/06 24/16 PB |
| 6,578,239 | B2 | 6/2003 | Hatch | |
| 6,751,828 | B2 | 6/2004 | Matschiner et al. | |
| 6,763,553 | B2 | 7/2004 | Hatch | |
| 6,807,714 | B2 | 10/2004 | O'Young et al. | |
| 7,017,237 | B2 | 3/2006 | Magno, Jr. et al. | |
| 7,676,892 | B2 | 3/2010 | Tomory et al. | |
| 7,866,005 | B2 * | 1/2011 | Vermeer et al. | B65D 63/1072 24/16 PB |
| 9,015,906 | B2 * | 4/2015 | Bartholomew | B65D 63/1045 24/16 PB |
| 2002/0083559 | A1 | 7/2002 | Hatch | |
| 2004/0049890 | A1 * | 3/2004 | Kurmis | B65D 63/14 24/16 PB |
| 2007/0175001 | A1 | 8/2007 | Tomory et al. | |
| 2012/0272485 | A1 | 11/2012 | Liang | |

FOREIGN PATENT DOCUMENTS

| | | | |
|---|---|---|---|
| JP | H09-040005 | A | 2/1997 |
| JP | H10-318217 | A | 12/1998 |
| JP | 2013-113330 | A | 6/2013 |
| JP | 2013-227084 | A | 7/2013 |
| WO | 2009/089316 | A1 | 7/2009 |

* cited by examiner

IN-LINE CABLE TIE WITH FLEXIBLE HEAD

CROSS REFERENCE TO RELATED APPLICATIONS

This application claims priority to U.S. Provisional Patent Application No. 62/024,612 filed on Jul. 15, 2014, the contents of which is incorporated herein by reference in its entirety.

FIELD OF THE INVENTION

The present invention relates to cable ties used to bundle an article or a group of articles. More specifically, the present invention relates to low profile cable ties having a flexible head.

BACKGROUND OF THE INVENTION

The use of cable ties to bundle or secure a group of articles is well known. Known cable ties of conventional construction are elongate members having a head at one end, a tail at the other end, and a longitudinal strap therebetween. The strap is wrapped around a bundle of articles and the tail is inserted through an aperture or passageway in the head. The head of the cable tie typically includes a locking element which is engageable with the body of the strap so that when the tail is pulled through the passageway in the head, the locking element secures the strap body in the head.

In certain situations, low profile cable ties are preferred as they sit low to the bundle and resist snagging. To maintain the low profile, the strap is inserted into the head in a direction substantially parallel to the strap body.

Conventional cable tie tools are used to pull the tail of the cable tie through the head of traditional cable ties. These tools typically cannot be effectively used on low profile cable ties.

Moreover, in such cable ties it is desirable to maintain a low insertion force for the tail into the head and a high retention force resisting withdrawal.

SUMMARY OF THE INVENTION

A low profile tie includes an elongate strap having a tail at one end. A locking head positioned at the other end of the strap has a passageway therethrough for insertable receipt of the tail. The strap includes a planar strap surface between said tail and the locking head having a plurality of notches therealong. The locking head includes a base portion and a head portion flexibly connected to the base portion with the passageway formed therebetween. The head portion includes a plurality of locking teeth extending into the passageway for engagement with the notches of said strap body upon the insertion of said tail. The notches engage a number of teeth less than all of the locking teeth upon the insertion of the strap into said passageway. The head is flexibly pivotal so that more than the locking teeth engage the notches upon an attempt to withdraw said strap from said head.

DETAILED DESCRIPTION OF THE PREFERRED EMBODIMENTS

Figure 1:
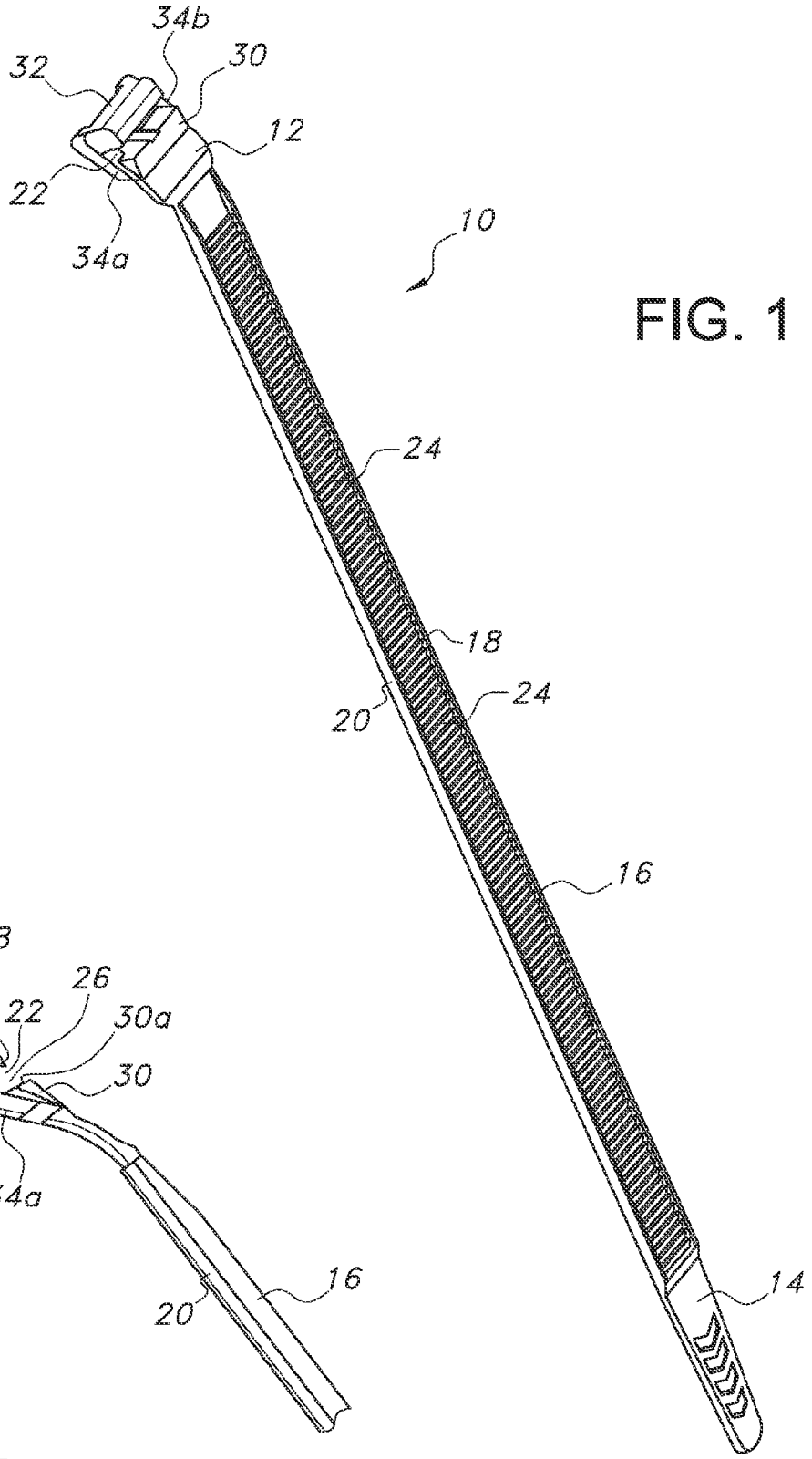
FIG. 1 is a perspective showing of the low profile cable tie of the present invention.
Figure 2:
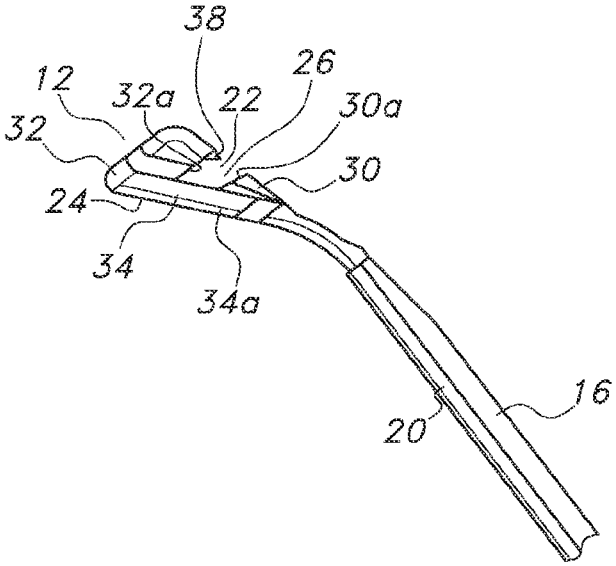
FIG. 2 is a partial plan view of the cable tie of FIG. 1.

FIGS. 1-5 show a cable tie 10 of the present invention. Cable tie 10 is an elongate member including a locking head 12, an opposed tail 14, and an elongate strap body 16 therebetween. Strap body 16 is typically planar shaped having first and second opposed major surface 18 and 20. Head 12 includes passageway 22 therethrough. Passageway 22 includes strap ingress end 24 and strap egress end 26. Strap surface 18 includes a plurality of spaced apart teeth-like notches 24 along the length thereof.

Locking head 12 includes a base portion 30 formed at one end of strap body 16 and a head portion 32 spaced from the base portion 30. Passageway 22 is defined between base portion 30 and head portion 22.

Head portion 32 is connected to base portion 30 by flexible connection 34 which permits pivoting of head portion 32 with respect to base portion 30. The flexible connection 34 is formed by a pair of spaced apart flexible rails 34*a* and 34*b* which also define passageway 22 therebetween.

Base portion 30 and head portion 32 include mutually facing surfaces 30*a* and 32*a*. Surface 30*a* of base portion is generally flat so as to support the flat surface 20 of strap body 16. Surface 32*a* includes a plurality of teeth 38, more fully shown in FIGS. 4 and 5, which extend into passageway 22.

Figure 3:
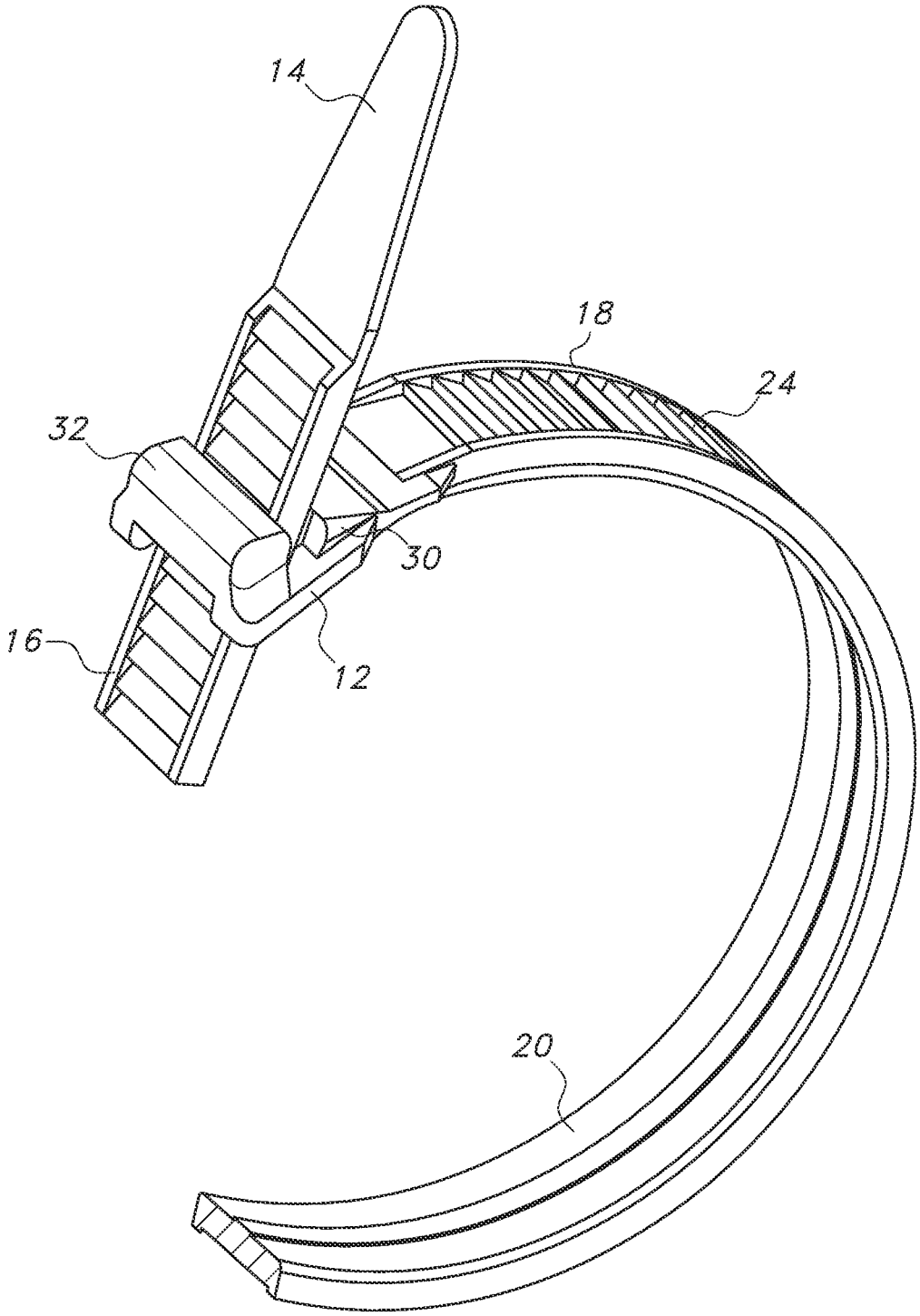
FIG. 3 is a partial perspective showing of the cable tie of FIG. 1 in the bundled position.
Figure 4:
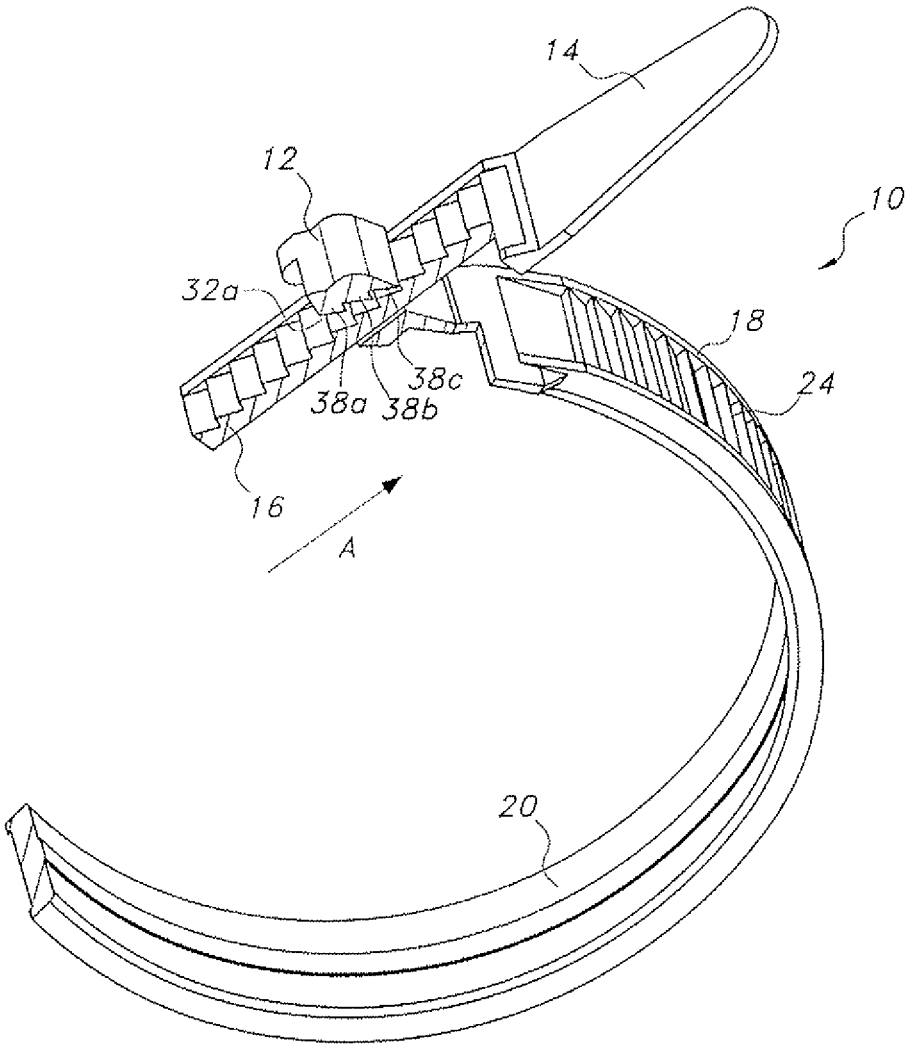
FIG. 4 shows the cable tie of FIG. 1 in the tail insertion position.
Figure 5:
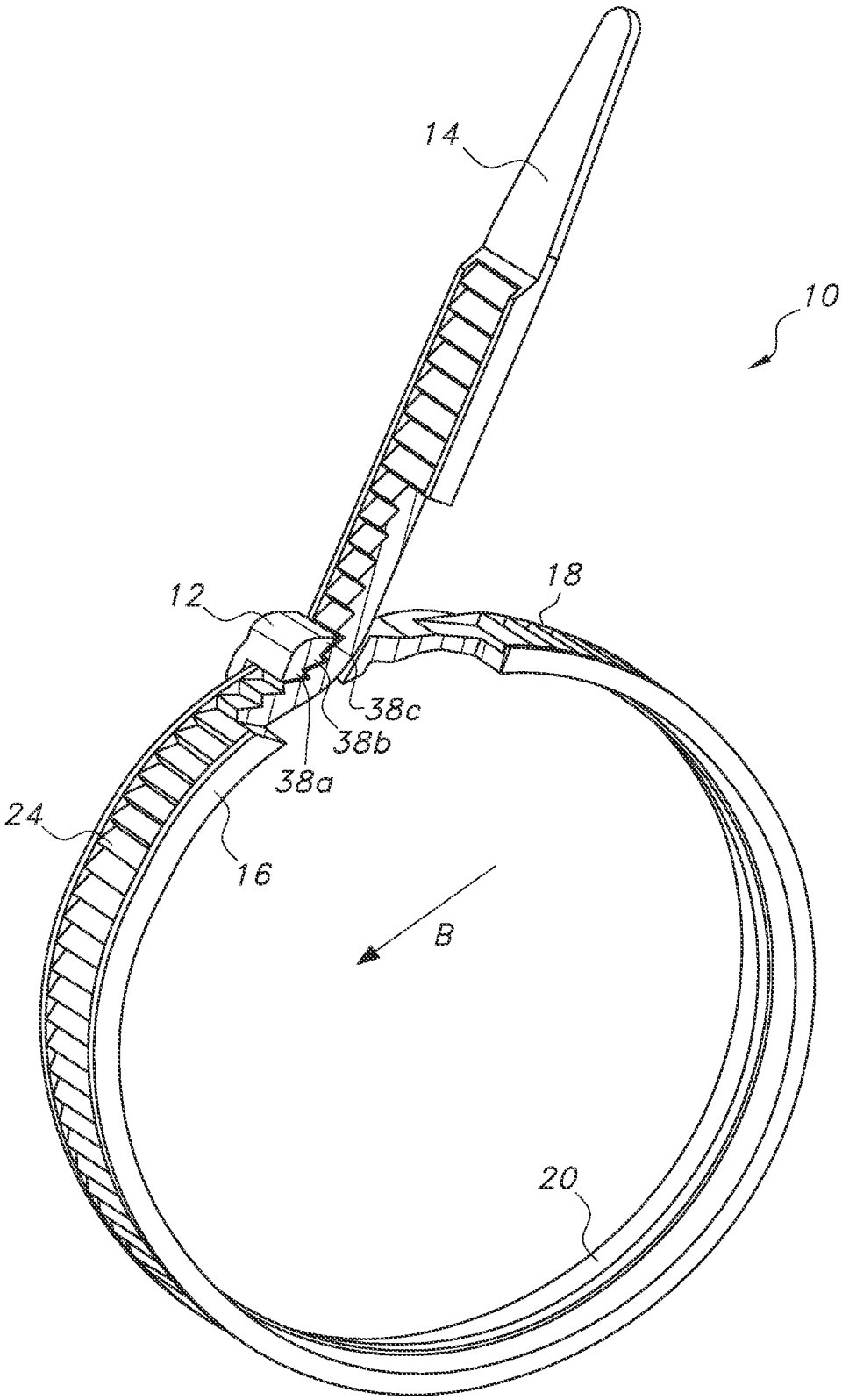
FIG. 5 shows the cable tie of FIG. 1 in the tail tensioned position.

Referring additionally to FIGS. 3-5, three teeth 38 are shown extending into passageway 22 from surface 32*a*. It may be appreciated that such number is only an example.

The three teeth 38*a*, 38*b*, 38*c* are arranged in succession in the direction of insertion (arrow A) of the strap body into passageway 22. The last tooth 38*c* extends further into the passageway than the other two teeth 38*a* and 38*b*, which are successively recessed.

Tooth 38*c* is positioned such that upon insertion of strap body 16 into passageway 22, the single tooth 38*c* (or less than all of the teeth) engages the notches 24 on the strap body 16. Such engagement of the single tooth 38*c* with the notches 24 allows the strap body 16 to be easily inserted through the passageway 22 in the direction of arrow A with low insertion force.

Once the strap is tightly bundled, an attempt to move the strap in a direction of arrow B (FIG. 5), opposite arrow A, such as by release of the tightening tension, the head portion 32 pivots inwardly towards base portion 30. The flexible rails 34*a* and 34*b* permit such rotation of head portion 32.

In the present invention, the teeth are fixed and the head portion 32 is flexible or rotatable thereby providing greater retention force.

The strap body 16 extends from the passageway 22 at an angle to the passageway of preferably about 40° to 50°. At such an angle and with the rotation of head portion 32 affected by the flexible connection, additional teeth 38*a* and 38*b* engage the notches. This engagement of multiple teeth with the notches provides a high retention force for the strap in the head. This angle also allows the low profile tie to be tensioned using conventional cable tie tools.

Thus, the present invention provides a low profile cable tie which allows insertion of the tail into the head with a low insertion force, yet once bundled, provides a high retention force for the strap in the head.

Various changes to the foregoing described and shown structures would now be evident to those skilled in the art. Accordingly, the particularly disclosed scope of the invention is set forth in the following claims.

What is claimed:

1. A low profile tie comprising:

an elongate strap having a tail at one end; and a locking head at the other end of said strap, said locking head having a passageway, wherein the tail is adapted to be inserted through the passageway in the head in a direction substantially parallel to said strap;

said strap including a planar strap surface between said tail and said locking head having a plurality of notches therealong;

said locking head including a base portion and a head portion, wherein said head portion is connected to said base portion by a flexible connection located between said head portion and said base portion, said flexible connection including a pair of spaced apart rails, said passageway formed between the head portion and the base portion and between said spaced apart rails;

said head portion including a plurality of locking teeth extending into said passageway for engagement with said notches of said strap surface;

wherein said locking head is arranged such that a number of teeth less than all of said locking teeth engage said notches upon said insertion of said strap into said passageway and wherein said head portion is flexibly pivotal by said flexible connection so that more than said number of said locking teeth engage said notches upon an attempt to withdraw said strap from said head.

2. A low profile tie of claim 1 wherein said head portion is rotatable with respect to said base portion.

3. A low profile tie of claim 1 wherein said head portion includes three teeth and wherein said notches engage one of said teeth upon insertion of said strap into said passageway.

4. A low profile tie of claim 3 wherein said last tooth in the direction of said insertion extends into said passageway a further distance than the other two said teeth.

5. A low profile tie of claim 3 wherein upon said attempt to withdraw said strap from said head all three of said teeth engage said notches.

6. A low profile tie of claim 1 wherein the tail extends from the head, upon insertion, at an angle of between about 40°-50°.

7. A low profile tie comprising:

an elongate strap having a tail at one end; and a locking head at the other end of said strap, said locking head having a passageway therethrough for insertable receipt of said tail;

said strap including a planar strap surface between said tail and said locking head and having a plurality of notches therealong;

said locking head including a base portion and a head portion flexibly connected to said base portion by a flexible connection between said head portion and said base portion said flexible connection including a pair of spaced apart rails with said passageway formed thereat;

said head portion including a plurality of locking teeth extending into said passageway for engagement with said notches of said strap surface;

one of said locking teeth engaging said notches upon said insertion of said strap body including said passageway and said head portion being rotatable with respect to said base portion to place all of said teeth into engagement with said notches upon an attempt to withdraw said strap from said passageway.

8. A low profile tie of claim 7 wherein said head portion includes three teeth and wherein said notches engage one of said teeth upon insertion of said strap into said passageway.

9. A low profile tie of claim 8 wherein upon attempting to withdraw said strap from said head, all three of said teeth engage said notches.

10. A low profile tie of claim 7 wherein the tail extends from said head, upon insertion, at an angle of about 40°-50°.

* * * * *